US005671668A

United States Patent [19]

Shih

[11] Patent Number: 5,671,668

[45] Date of Patent: Sep. 30, 1997

[54] HAND STAMP

[76] Inventor: Shiny Shih, No. 31, Lane 349, Chungcheng S. Rd., Yungkang City, Tainan Hsien, Taiwan

[21] Appl. No.: 651,861

[22] Filed: May 21, 1996

[51] Int. Cl.[6] ..... B41J 27/02; B41K 1/40

[52] U.S. Cl. ..... 101/104; 101/334

[58] Field of Search ..... 101/104, 105, 101/334

[56] References Cited

U.S. PATENT DOCUMENTS

| | | | |
|---|---|---|---|
| 454,499 | 6/1891 | Ryer | 101/334 |
| 1,710,633 | 4/1929 | Marks | 101/105 |
| 2,313,727 | 3/1943 | Nisenson | 101/104 |
| 5,517,916 | 5/1996 | Dour et al. | 101/334 |

*Primary Examiner*—Edgar S. Burr
*Assistant Examiner*—Leslie Grohusky
*Attorney, Agent, or Firm*—Bacon & Thomas

[57] ABSTRACT

A hand stamp is set forth which allows normal stamping of a signature and allows a matrix plate thereof to be reversed when not in use in order to prevent abrasion of the matrix. This hand stamp includes a first member having an n-shaped structure and a handle integrally formed on the n-shaped structure with the n-shaped structure defining a first internal space. A plurality of guides are placed respectively on an inside of a first pair of sidewalls of the n-shaped structure. A second member is movably received within the space of the first member with the second member defining hog portions at appropriate positions. A substantially rectangular plate with a slightly smaller area than the cross-sectional area of the second member is received within a second internal space of the second member with the rectangular plate having two bosses respectively defined on a pair of wing surfaces extending from the rectangular plate and being rotatably received within the hog portions of the second member. A matrix plate with an approximate dimension similar to that of the substantially rectangular plate is replaceably attached to the substantially rectangular plate in order to rotate with the substantially rectangular plate. A series of different matrix plates with various matrix inscriptions thereon can be replaced and used on the same hand stamp.

5 Claims, 6 Drawing Sheets

HAND STAMP

BACKGROUND OF THE INVENTION

1. Field of the Invention

The present invention relates to a hand stamp and, more particularly to a hand stamp which allows stamping a normal signature and allows a matrix plate thereof to be reversed when not in use in order to prevent abrasion of the matrix. Furthermore, a series of easily-replaced matrix plates with various matrix formed thereon is adaptable for use on the same hand stamp.

2. Description of Related Art

Hand stamps are commonly used in everyday life and particularly in a company or firm. Early hand stamps were formed of rubber and needed to be dipped in ink before being used. This kind of hand stamp has a disadvantage in that it is incapable of providing a continuous stamped signature. To overcome the problem with this hand stamp, a hand stamp using a matrix plate with a layer of ink disposed thereon to provide a continuous signature was proposed. However, abrasion of the matrix may possibly occur after long usage because the matrix is always provided at a bottom of the hand stamp. Later, an advanced hand stamp was developed. This advanced hand stamp is composed of a body, an enclosure movable with respect to the body, a support plate joined within the enclosure by a pin, and a matrix plate attached on the support plate. The hand stamp further uses two actuating pieces to cause the support plate together with the matrix plate to reverse upon stamping a signature so as to enable the matrix plate to be stored within the enclosure when not in use and prevent abrasion of the matrix. Though this kind of hand stamp does overcome the above problems to some extent and further provides replaceable matrix plates, however, more elements such as the actuating pieces are required. Also, the two actuating pieces are designed as individual elements, therefore, it may cause errors during driving the element in operation. Furthermore, it is not convenient for the matrix plates to be replaced.

The present invention provides an improved hand stamp to mitigate and/or obviate the aforementioned problems.

SUMMARY OF THE INVENTION

One object of the present invention is to provide a hand stamp which allows stamping a normal signature and allows the matrix plate to be reversed when not in use in order to prevent abrasion of the matrix.

Another object of the present invention is to provide a hand stamp which may receive a series of matrix plates with various and different matrices thereon, and furthermore to easily replace these matrix plates.

In accordance with one aspect of the present invention, the hand stamp comprises a first member having an n-shaped structure and a handle integrally formed on the n-shaped structure with the n-shaped structure defining a first internal space and a plurality of guides respectively formed on an inside of a first pair of sidewalls of the n-shaped structure; a second member is movably received within the space of the first member with the second member having a front wall, a rear wall and a second pair of sidewalls with the four walls defining a second internal space, each of the pair of sidewalls respectively defining a plurality of flanges spaced on an outside thereof so as to be engaged with the guides of the first member, a slotted hole parallel to and spaced between the flanges, a channel guide parallel to the flanges on an inside of the sidewall with the channel guide being communicated with the slotted hole and defining a hog portion midway thereof with the hog portion having two lugs respectively disposed at an upper end and a lower end thereof; a substantially rectangular plate with a slightly smaller area than the cross-sectional area of the second member, received within the second internal space with the rectangular plate having two wings integrally extending from two opposed short sides thereof and perpendicular to the plate face, each of the wings having a boss formed thereon and allowed to rotatably move within the hog portion and the channel guide of the second member and a block stop with two parallel notches adjacent to the boss at a side near the plate face, parallel notches being provided for retaining the lugs of the hog portion of the second member; and a matrix plate, with an approximate dimension similar to that of the substantially rectangular plate, replaceably attached to the substantially rectangular plate in order to rotate with the substantially rectangular plate.

In accordance with another aspect of the present invention, each the first pair of sidewalls of the first member defines a dent at a bottom thereof and a hole thereon corresponding to the slotted hole of the second member, and wherein the boss of the substantially rectangular plate defines a central hole between the boss and the stop block so that a pin may be inserted into the holes to engage the first member and the second member, together with the substantially rectangular plate.

In accordance with a further aspect of the present invention, the substantially rectangular plate further comprises a pair of grip blocks respectively and integrally extending from a pair of short sides thereof, opposite from the two wings for holding the matrix plate.

In accordance with a still further aspect of the present invention, the substantially rectangular plate further defines a pair of notches at one long edge thereof, and wherein the matrix plate further comprises a pair of protrusions integrally extending from a long side thereof corresponding to the pair of notches so that a user can readily retrieve the matrix plate from the rectangular plate for replacement.

Other objects, advantages and novel features of the invention will become more apparent from the following detailed description when taken in conjunction with the accompanying drawings.

DETAILED DESCRIPTION OF PREFERRED EMBODIMENT

Figure 1:
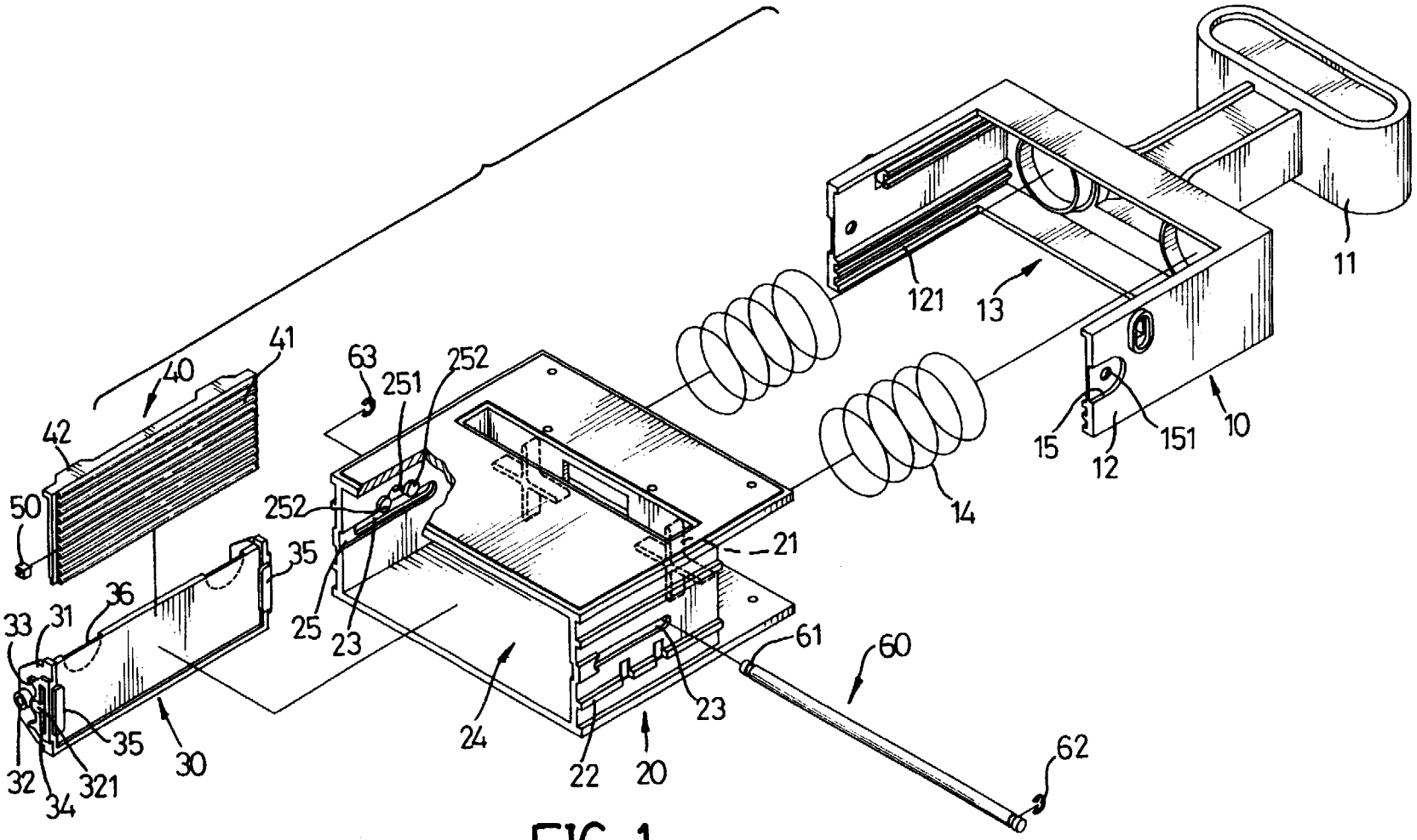
FIG. 1 is a perspective view showing the hand stamp in accordance with the present invention.

Referring to FIG. 1, there is shown a perspective view of the hand stamp in accordance with the present invention. The hand stamp comprises a first member 10 having an n-shaped structure and a handle 11 integrally formed on the n-shaped structure. The n-shaped structure 10 has a top wall (not numbered) and a first pair of sidewalls 12, and defines a first internal space 13 therebetween. A plurality of guides 121 is provided in a longitudinal direction respectively on an inside of the first pair of sidewalls 12 of the n-shaped structure 10. A pair of dents 15 are each respectively defined at a bottom and on an outside of the first pair of sidewalls 12. A pair of holes 151 are each respectively defined in the pair of dents 15.

A second member 20 is movably received within the space 13 of the first member 10. The second member 20 includes a front wall, a rear wall and a second pair of sidewalls, all of which define a second internal space 24. At an upper portion of the space 24, there is disposed an ink box (not shown). Each of the second pair of sidewalls respectively defines a plurality of flanges 22 spaced on an outside thereof so as to be engaged with the guides 121 of the first member 10. A slotted hole 23 parallel to the flanges 22 is spaced between the flanges 22 on each of the second pair of sidewalls in alignment with the hole 151 of the first member so that a pin 60, in turn, may be inserted into the holes 151 and the slotted holes 23 to engage the first member 10 with the second member 20 and be allowed to move within the slotted holes 23. Two parallel cross pieces 21 (shown in phantom) are disposed at a top of the space 24 so that two corresponding springs 14 may be compressed between the cross pieces 21 and the top wall of the first member to enable the second member 20 to slidably move respective to the first member 10. The respective movement of the first and second members 10, 20 is allowed until the pin 60 is retained at one end of the slotted hole 23. In addition, channel guides 25 parallel to the flanges 22 on an inside of the second pair of sidewalls communicate with the slotted holes 23 on an inside of the sidewalls and define a hog portion 251 midway at each side thereof. The hog portion 251 traverses and extends from an inside to an outside of the sidewall, and has two lugs 252 respectively disposed at an upper end and an lower end thereof.

A substantially rectangular plate 30 is received within the space 24 and engages with the second pair of sidewalls. It is noted that the substantially rectangular plate 30 has a slightly smaller area than the cross sectional area of the second member 20. The substantially rectangular plate 30 has two wings 31, perpendicular to the plate face, integrally extending from two opposed short sides. Each of the wings 31 has a boss 32 formed thereon and received in the hog portion 251, a central hole 321 adjacent to the boss 32 at a side near the plate face for passing by the pin 60, and a block stop 34 with two parallel notches 33 at a position adjacent to the central hole 321 for retaining the lugs 252 of the hog portion 251 of the second member 20, whereby the substantially rectangular plate 30 has a reversible motion in the space 24. The substantially rectangular plate 30 further comprises a pair of grip blocks 35 respectively and integrally extended from the pair of short sides, opposite from the two wings 31, for holding a matrix plate 40. The matrix plate 40, with an approximate dimension the same as that of the substantially rectangular plate 30, has several recesses 41 on one face for locating a plurality of matrixes 50. The matrix plate 40 is movably held by the pair of grip blocks 35 of the substantially rectangular plate 30, with the matrix face exposed and the other face attached to the plate face of the substantially face so that the matrix plate 40 can be reversed with the substantially rectangular plate 30. The matrix plate 40 further has a pair of protrusions 42 integrally extending from one long side thereof. A pair of notches 36 are defined at a portion beneath the protrusions 42 on the substantially rectangular plate 30 in order to facilitate retrieval when the matrix plate is replaced.

Figure 2:
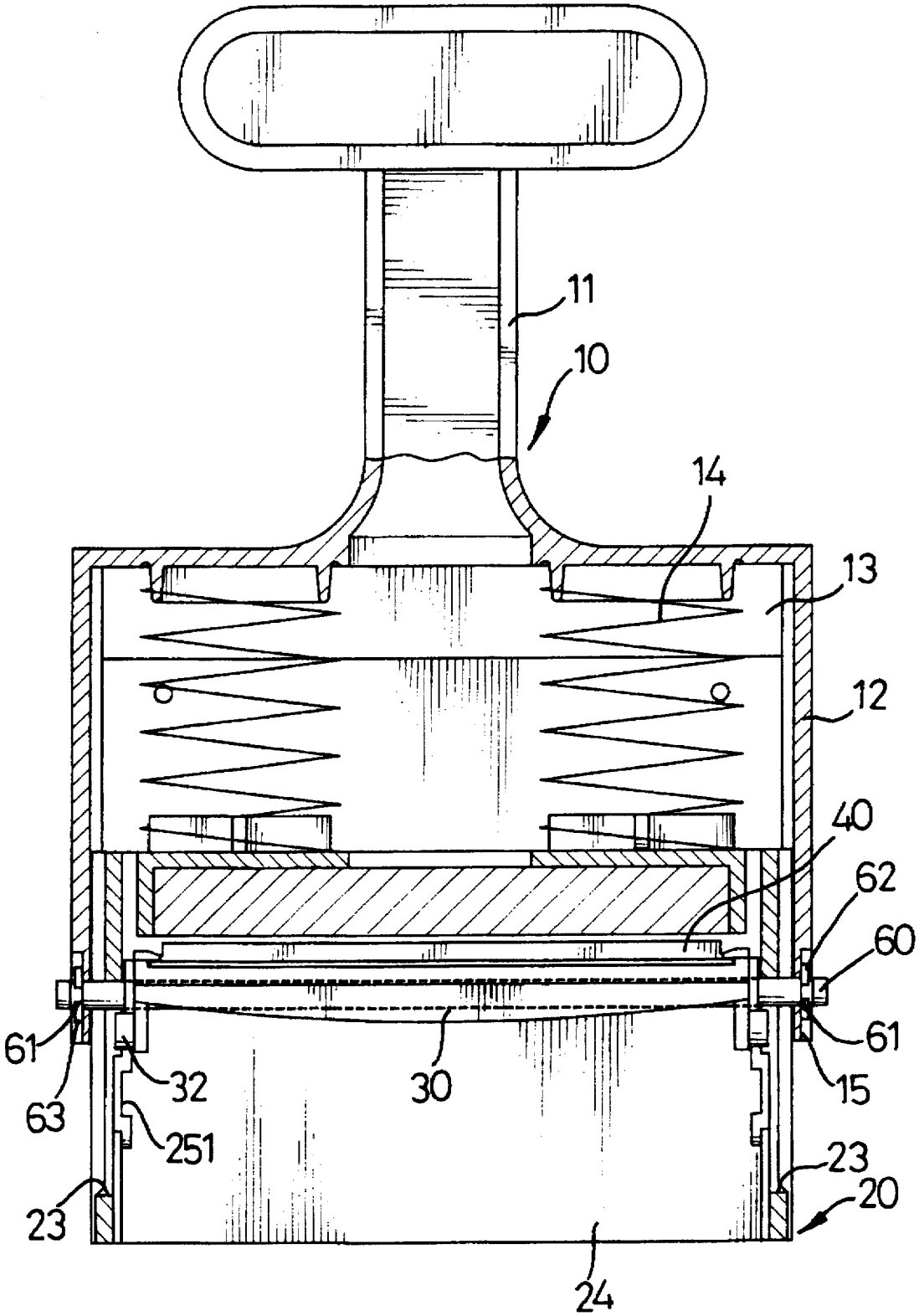
FIG. 2 is a longitudinal-sectional view of the hand stamp in accordance with the present invention.
Figure 3:
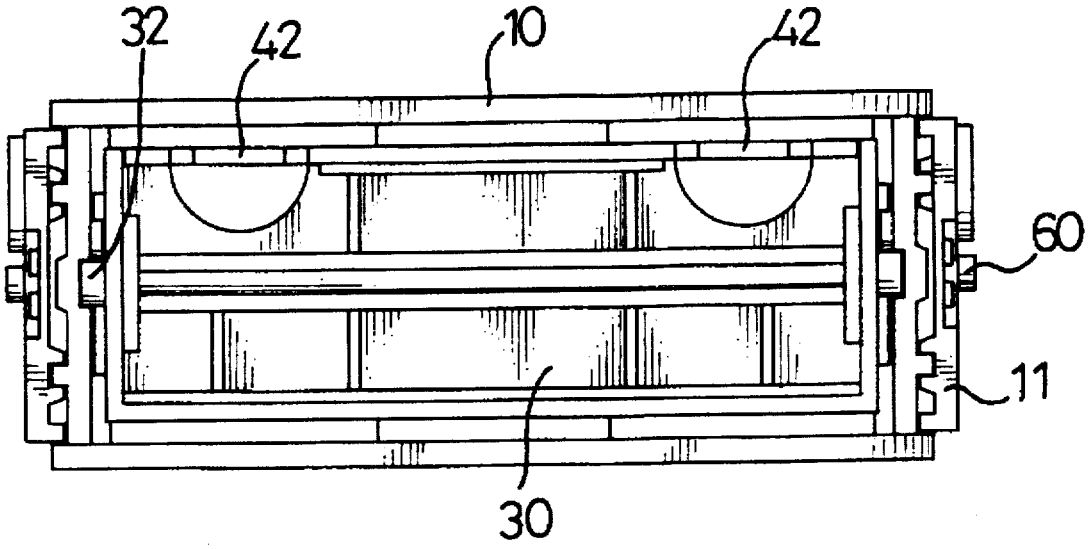
FIG. 3 is a cross-sectional view of the hand stamp in accordance with the present invention.

Referring to FIG. 1, FIG. 2 and FIG. 3, in assembly, first, the flanges 22 of the second member 20 are inserted into the guides 121 of the first member 10 and the springs 14 are provided and compressed between the first member 10 and the second member 20. The pin 60 is then inserted into the holes 151 of the first member, the slotted holes 23 of the second member 20 and the central holes 321 of the rectangular plate to engage these members together. Since the pin 60 has two ring grooves 61 respectively defined at two ends thereof, two buckles 62, 63 can be provided to fasten the pin 60 at the ring grooves 61 at an outside of the first member 10. It is noted that the two buckles 62, 63 may be embedded into the two dents 15 of the first member so as to prevent catching.

Figure 5:
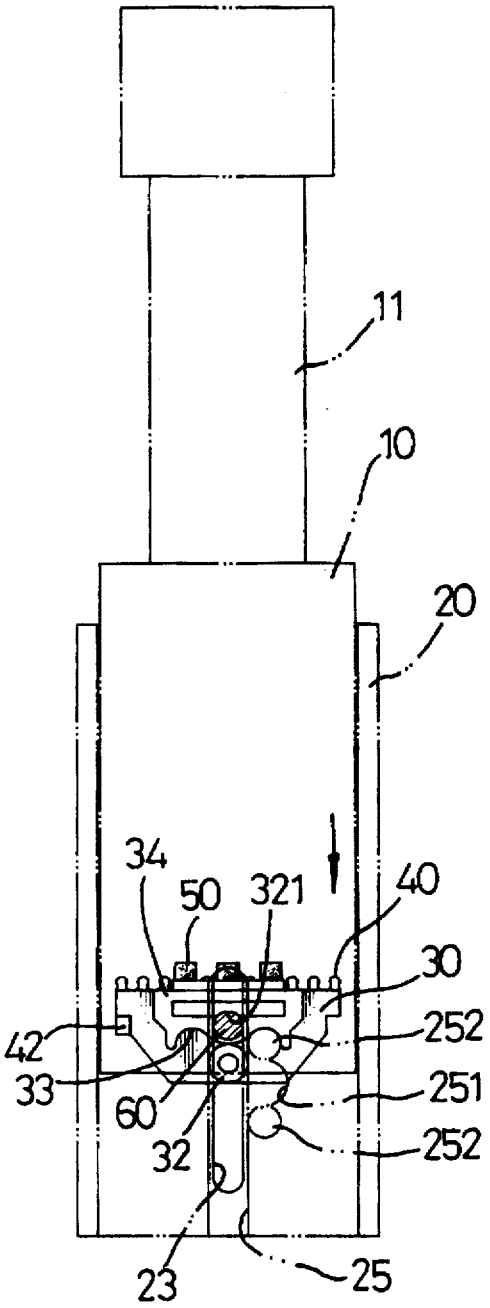
FIG. 5 is a second schematic view showing the stamping operation in accordance with the present invention.
Figure 4:
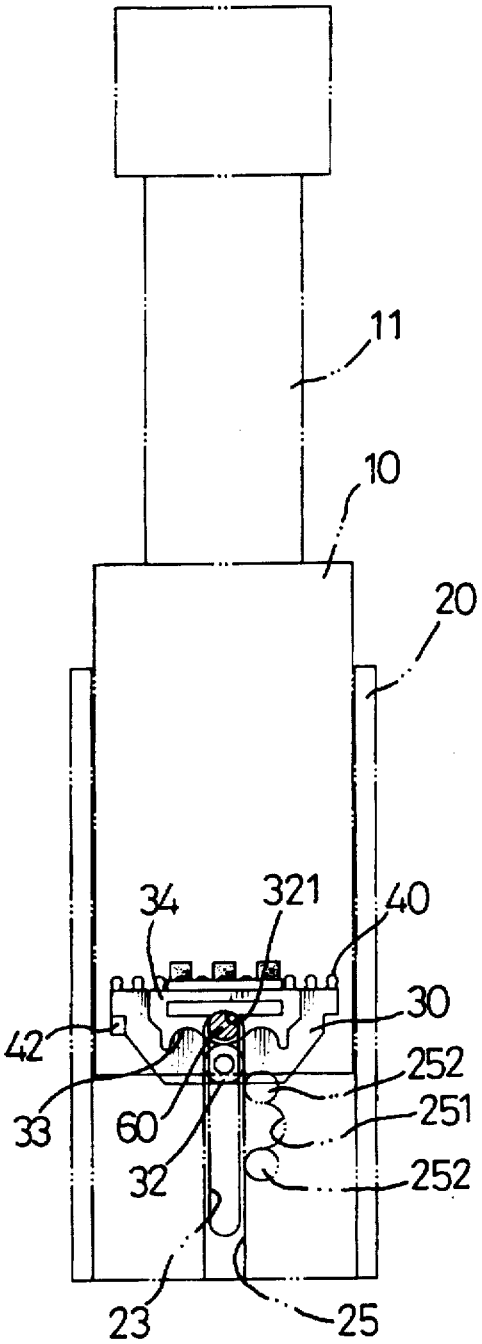
FIG. 4 is a first schematic view showing the stamping operation in accordance with the present invention.
Figure 7:
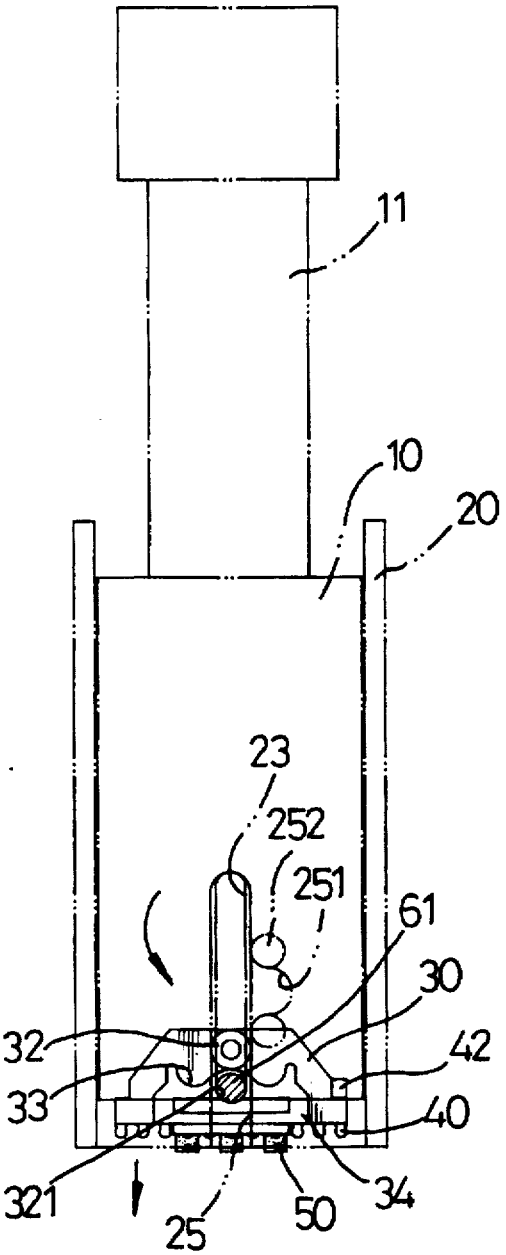
FIG. 7 is a fourth schematic view showing the stamping operation in accordance with the present invention.
Figure 6:
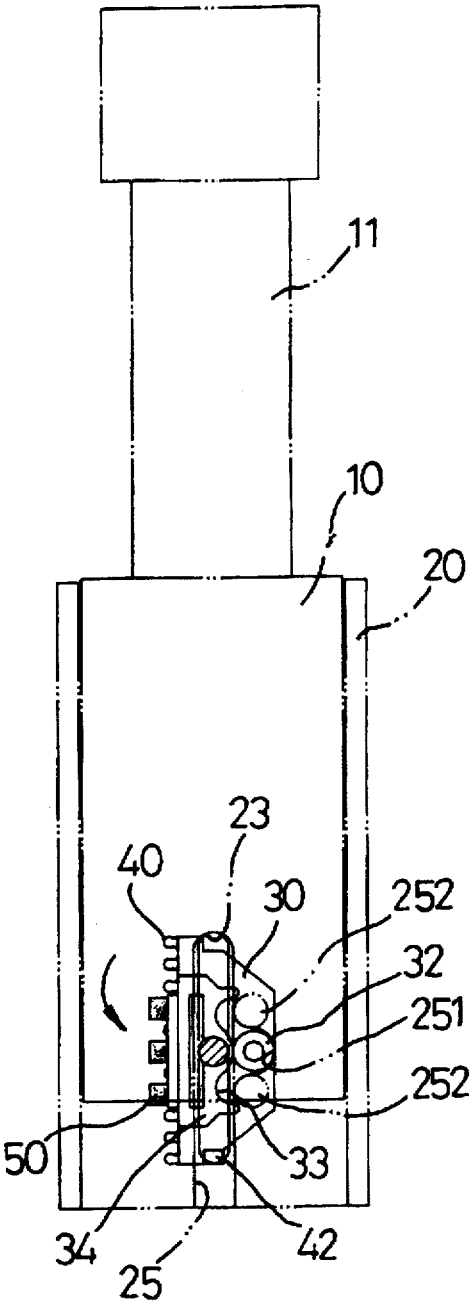
FIG. 6 is a third schematic view showing the stamping operation in accordance with the present invention.

The present invention has an advantage in that it allows stamping normal signatures and allows the matrix plate 40 to be reversed when not used in order to prevent abrasion of the matrices 50. In operation, referring to FIG. 2 and FIG. 4, when the present invention is used for stamping signatures (before stamping, the matrix plate in the space 24 is exposed upwardly and absorbs ink from the ink box within the second member for application to paper), a user can hold the second member 20 on paper or other plane surfaces and press the handle 11 downwardly. Referring to FIG. 5, the springs 14 (shown in FIG. 2) are compressed and the bosses 32 on the rectangular plate 30 are moved downwardly from the upper end of the slotted holes 23 to the hog portion 251 by guidance of the pin 60 and the upper lugs 252. Referring to FIG. 6, the bosses 32 will be rotated due to the configuration of the hog portion 251 to reverse the substantially rectangular plate 30 and enable the matrix plate 40 to face downwardly. Then referring to FIG. 7, the substantially rectangular plate 30 is forced to move downwardly along the slotted hole 23 until the bosses 32 are retained by the lower end of the slotted hole 23. It is noted that the height between the lower end of the slotted holes 23 and the bottom edge of the second member 20 is slightly smaller than the thickness of the combined substantially rectangular plate 30 and the matrix plate 40 in order to assure that the matrix plate 40 sufficiently contacts the paper or other surfaces. When the user relaxes the springs 14, the bosses 32 return from the lower end of the slotted hole 23 and are rotated to reverse the matrix plate 40 back after passing through the lower lug 252 of the hog portion 251. Thereby, the rectangular plate is continuously moved along the slotted hole 23 until it returns to the initial location as shown in FIG. 4.

Figure 8:
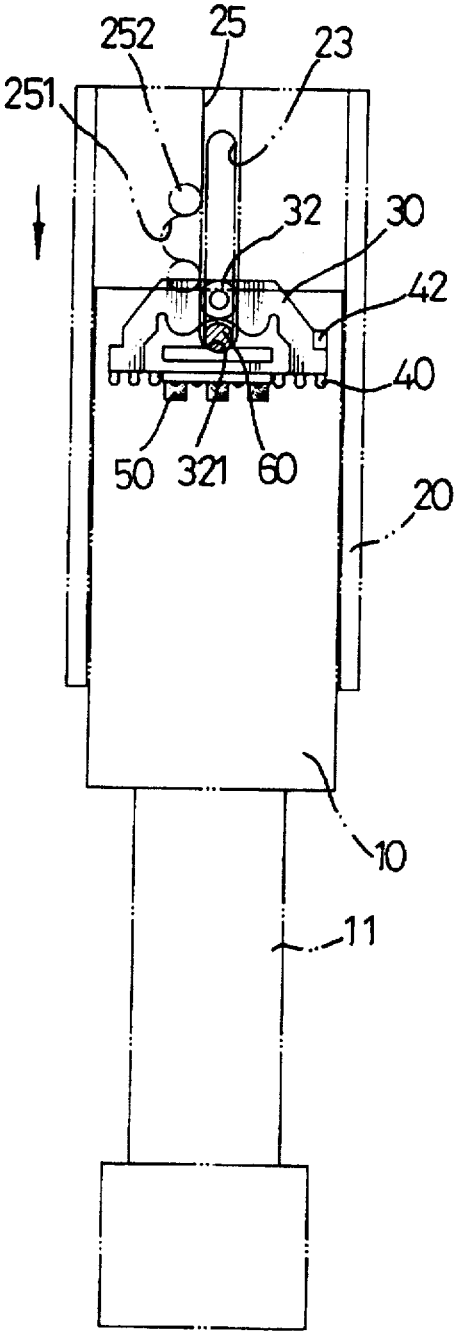
FIG. 8 is a fifth schematic view showing the operation of switching a matrix of the hand stamp in accordance with the present invention.
Figure 9:
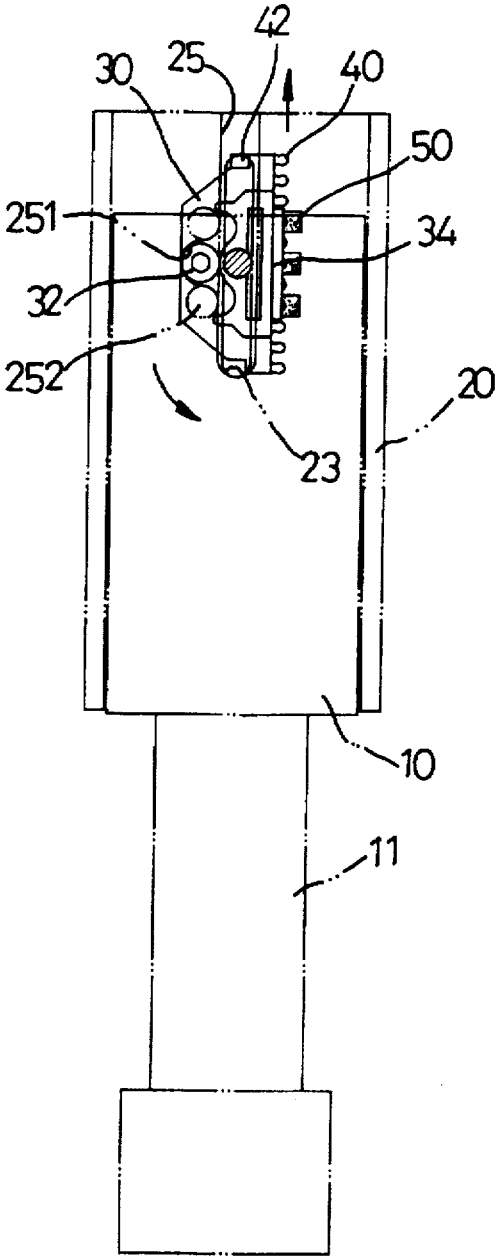
FIG. 9 is a sixth schematic view showing the operation of switching a matrix of the hand stamp in accordance with the present invention.

The present invention has another advantage in that a series of matrix plates with various or different matrices thereon can be received on the same hand stamp, and are easy to replace. If replacement of the matrix plates is required, a user can retain the handle 11 on a plane and press the second member 20 downwardly, as shown in FIG. 8. Then the matrix plate 40 will be rotated in a manner as mentioned above. The second member 20 will remain pressed down until the matrix plate 40 has rotated 90° in an anti-clockwise direction, as shown in FIG. 9. In this case, the protrusions 42 of the matrix plate 40 and the notches 36 of the rectangular plate 30 are exposed and the user can readily pull out the matrix plate 40 for replacement from the rectangular plate.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hand stamp comprising:

a first member having an n-shaped structure and a handle integrally formed on the n-shaped structure, said n-shaped structure having a first pair of side walls defining a first internal space and a plurality of guides respectively on an inside of the first pair of sidewalls of the n-shaped structure;

a second member movably received within the space of the first member, said second member having a front wall, a rear wall and a second pair of sidewalls, said four walls defining a second internal space, each of said second pair of sidewalls respectively defining a plurality of flanges spaced on an outside thereof engaged with the guides of the first member, a slotted hole parallel to and spaced between said flanges, a channel guide parallel to the flanges on an inside of each of said second pair of sidewalls, said channel guide communicating with the slotted hole and defining a hog portion at a midway portion thereof, said hog portion having lugs respectively disposed at an upper end and a lower end thereof;

a substantially rectangular plate with a smaller area than the cross-sectional area of the second member received within the second internal space, said substantially rectangular plate having wings extending from two opposed short sides thereof perpendicular to the substantially rectangular plate, each of said wings having a boss formed thereon to rotatably move within each hog portion and each channel guide of the second member, and a block stop with two parallel notches adjacent to the boss at a side of the substantially rectangular plate, parallel notches being provided for retaining the lugs of the hog portion of the second member; and a matrix plate with an approximate dimension the same as that of the substantially rectangular plate replaceably attached to the substantially rectangular plate in order to rotate with the substantially rectangular plate.

2. The hand stamp as claimed in claim 1, wherein each of the first pair of sidewalls of the first member defines a dent at a bottom thereof and a hole thereon corresponding to the slotted hole of the second member, and wherein the boss of the substantially rectangular plate defines a central hole between the boss and the block stop, and a pin inserted into said hole of said first member, said slotted hole and said central hole engaging the first member, the second member, and the substantially rectangular plate.

3. The hand stamp as claimed in claim 2, wherein the pin has a ring groove respectively at two ends thereof, and wherein two buckles fasten the pin at the ring grooves outside of the first member to be embedded within said dents on the first member.

4. The hand stamp as claimed in claim 1, wherein the substantially rectangular plate further comprises a pair of short sides, and wherein a pair of grip blocks extends from the pair of short sides opposite from the two wings for holding said matrix plate.

5. The hand stamp as claimed in claim 1, wherein the substantially rectangular plate further defines a pair of notches at one long edge thereof, and wherein the matrix plate further comprises a pair of protrusions extending from a long side thereof corresponding to the pair of notches to enable a user to readily retrieve the matrix plate from the substantially rectangular plate for replacement.

* * * * *